United States Patent [19]

Nagasaka et al.

[11] 4,131,644

[45] Dec. 26, 1978

[54] PROCESS FOR PRODUCING CARBON FIBER

[75] Inventors: Akira Nagasaka, Chiba; Hidetomo Ashitaka, Ichihara; Yoshihiro Kusuki, Ichihara; Denichi Oda, Ichihara; Toshimune Yoshinaga, Fukuoka, all of Japan

[73] Assignee: Ube Industries, Inc., Ube, Japan

[21] Appl. No.: 780,520

[22] Filed: Mar. 23, 1977

Related U.S. Application Data

[63] Continuation of Ser. No. 465,131, Apr. 29, 1974, abandoned.

[30] Foreign Application Priority Data

Mar. 29, 1974 [JP] Japan ..... 49-34619

[51] Int. Cl.[2] ..... C01B 31/07

[52] U.S. Cl. ..... 423/447.5; 264/29.2; 423/447.2; 423/447.4

[58] Field of Search ..... 260/29.2; 423/447.1, 423/447.2, 447.5, 447.4

[56] References Cited

U.S. PATENT DOCUMENTS 3,720,759 3/1973 Overhoff ..... 423/447.5
3,928,544 12/1975 Yokota et al. ..... 423/447.5
3,937,775 2/1976 Horikiri et al. ..... 264/29.2

FOREIGN PATENT DOCUMENTS 48-94697 12/1973 Japan ..... 264/29.2

*Primary Examiner*—Jay H. Woo
*Attorney, Agent, or Firm*—Miller and Prestia

[57] ABSTRACT

Carbon fibers having excellent modulus of elasticity and tensile strength are produced in a high yield by a process wherein polybutadiene fibers are prepared by melt-spinning polybutadiene having at least 85% of vinyl structure, a melting point of at least 100° C and a reduced viscosity of 0.3 to 1.2 dl/g; the fibers are then treated in a solution or suspension of a Lewis acid in an inert organic liquid, whereby the pollybutadiene is cyclized and cross-linked; the polybutadiene fibers treated as mentioned above are further treated in a melted sulphur or a sulphur-containing solution at a temperature of 170 to 300° C, whereby the cyclized and cross-linked polybutadiene is dehydrogenated and aromatized; and the fibers treated as mentioned above are carbonized by raising the temperature thereof to 750° C to 3000° C to form carbon fibers or graphite fibers. If so desired, the ordinary carbon fibers which have been produced at 750 to 1500° C, can be converted to graphite fibers by heating them to a temperature of 1500 to 3000° C.

9 Claims, 1 Drawing Figure

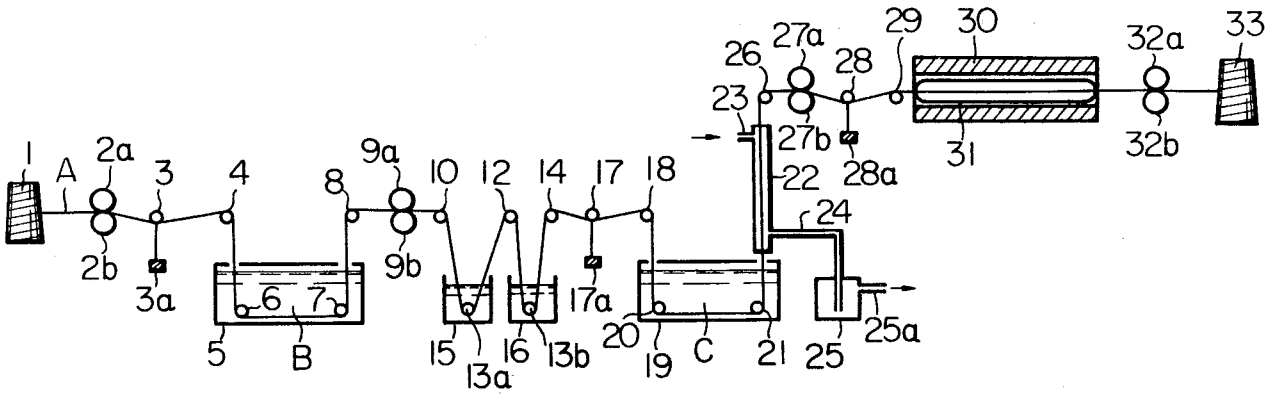
1
A
2a
2b
3
3a
4
5
B
6
7
8
9a
9b
10
12
13a
15
16
13b
14
17
17a
18
20
19
C
21
25
25a
23
26
27a
27b
22
24
28
28a
29
30
31
32a
32b
33

PROCESS FOR PRODUCING CARBON FIBER

This is a continuation of application Ser. No. 465,131 filed Apr. 29, 1974 now abandoned.

The present invention relates to a process for producing carbon fibers, more particularly, relates to a process for producing a high yield of carbon fibers having excellent modulus of elasticity and tensile strength, from polybutadiene fibers.

The term "fiber" used herein refers to discontinuous fiber or continuous filament. The "fiber" may be in the form of a single fiber or filament, or a bundle (sliver, top or tow), strand, thread or yarn.

The term "carbon fiber" used herein refers to ordinary carbon fiber and graphite fiber.

In the following description, content in percent of the vinyl structure of polybutadiene was determined in a manner such that a solution of 2.5 to 5% by weight of polybutadiene dissolved in o-dichlorobenzene was subjected to measurement of a nuclear magnetic resonance spectrum of the polybutadiene at a temperature of 100° C by using, as an internal standard, tetramethylsilane, and the content of the vinyl structure was calculated from the above-obtained spectrum. If the polybutadiene used was difficult to dissolve in o-dichlorobenzene, the content of the vinyl structure was calculated from an infra-red absorption spectrum measured by the conventional potassium bromide tablet method.

The melting point of polybutadiene was determined from the peak point in heat-absorption in a thermograph which was measured by a differential scanning calorie meter while heating polybutadiene at a rate of increase of temperature of 10° C/min in a nitrogen atmosphere.

The reduced viscosity of polybutadiene was determined by measuring the viscosity of a solution of 0.150 g of polybutadiene in 100 ml of tetrahydronaphthalene at a temperature of 135° C.

In conventional processes, carbon fibers are produced by carbonizing regenerated cellulosic fibers or filaments (rayon), acrylonitrile homo- or co-polymer fibers or petroleum pitch fibers. In the case where the carbon fibers are produced from rayon, carbonization of the rayon required strictly requires pirorysis, which causes low productivity and yield of the carbon fibers.

In the case where the acrylonitrile homo- or co-polymer fibers are preoxidized and, then, converted to carbon fibers, a fair amount of hydrogen cyanide gas which is highly toxic to the human body evolves during the carbonization of preoxidized fibers. Also, it is known that the yield of carbon fibers from acrylonitrile homo- or co-polymer fibers is low, usually less than 50%.

In the case where petroleum pitch fibers are used as precursor fibers, generally the yield of carbon fibers is high, often about 85 to 90%. However, the precursor fibers are so brittle that careful handling is required to pevent breakage of the fibers during stabilizing and carbonizing thereof.

Accordingly, in order to produce carbon fibers on an industrial scale, it is necessary to eliminate the above-mentioned disadvantages of the conventional processes.

The object of the present invention is to provide a process for producing a high yield of carbon fibers having excellent modulus of elasticity and tensile strength, from relatively cheap material fibers.

The above-stated object is accomplished by the process of the present invention. The process of the present invention comprises the successive steps of:

(a) preparing, by melt-spinning, polybutadiene fibers consisting essentially of a polybutadiene which contains at least 85% of vinyl structure and has a melting point of at least 100° C and a reduced viscosity of 0.3 to 1.2 dl/g;

(b) treating the polybutadiene fibers with a solution or suspension of a Lewis acid in an inert organic liquid to cyclize and cross-link said polybutadiene;

(c) further treating the polybutadiene fibers treated in step (b) with sulphur at a temperature of 170 to 300° C to dehydrogenate and aromatize the polybutadiene, treated in step (b), and;

(d) carbonizing the fibers treated in step c) by heating them to a temperature of 750° C to 3000° C, whereby said fibers are converted to carbon fibers.

If ordinary carbon fibers are desired, the carbonizing temperature is adjusted to within the range of from 750 to 1500° C. If graphite fibers are desired, the carbonizing is carried out at a temperature of 1500 to 3000° C.

The polybutodiene usable for the process of the present invention contains at least 85%, preferably, at least 88% of vinyl structure and has a melt point of at least 100° C, preferably, 140 to 195° C, more preferably, 145 to 193° C, and a reduced viscosity of 0.3 to 1.2 dl/g, preferably, 0.5 to 0.9 dl/g. This type of polybutadiene appears to have a high syndiotacticity in view of its absorption at a wave number of 660 $cm^{-1}$ in the infrared absorption spectrum.

The above-stated type of polybutadiene may be produced by conventional processes, for example, in accordance with the processes disclosed in U.S. Pat. No. 3,778,424, B. P. 1,310,621, Japanese Pat. Application Publication Nos. 47-19892, 47-19893, 35-13242 or 38-2140.

The polybutadiene fibers usable for the process of the present invention may be produced by melt-spinning. That is, the above-mentioned type of polybutadiene is melted at a temperature higher than its melting point and extruded through spinning orifices. The melt-spun polybutadiene fibers may be drawn at a draw ratio of about 1.3 to about 6.0 to produce highly oriented polybutadiene fibers. The polybutadiene fiber usable for the present invention has, preferably, a diameter of 4 to 30 μ, more preferably, 5 to 20 μ. In order to obtain carbon fibers having excellent modulus of elasticity, it is desirable to draw the melt-spun polybutadiene fibers at a proper draw ratio. The drawing operation results in an increase of the degree of orientation of the fibers. After the drawing is completed, the drawn fibers may be heat-set at a temperature 20° C less than the melting point of the polybutadiene but not lower than 70° C.

If the polybutadiene has a relatively high melting point, for example, 160 to 195° C, it is preferable to blend the polybutadiene with at least one acrylic compound of the formula (I):

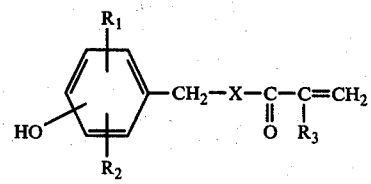

(I)

wherein X represents a member selected from the group consisting of —$OCH_2NH$—, —NH— and —O—, $R_1$ and $R_2$ represent an alkyl radical having 1 to 4 carbon atoms, and $R_3$ represents either a hydrogen atom or a methyl radical.

The acrylic compound of the formula (I) may be, for example, acrylaminomethyl-(3,5-di-tert-butyl-4-hydroxybenzyl) ether, acrylaminomethyl-(2-hydroxy-3,5-di-tert-butylbenzyl) ether, acrylaminomethyl-(2-hydroxy-3-tert-butyl-5-methylbenzyl) ether, acrylaminomethyl-(3,5-dimethyl-4-hydroxybenzyl) ether, methacrylaminomethyl-(3,5-di-tert-butyl-4-hydroxybenzyl) ether, (4-hydroxy-3,5-di-tert-butylbenzyl) acrylate, (2-hydroxy-3-tert-butyl-5-methylbenzyl) acrylate, (4-hydroxy-3,5-dimethylbenzyl) acrylate, (4-hydroxy-3,5-di-tert-butylbenzyl) methacrylate, (4-hydroxy-3,5-di-tert-butylbenzyl) acrylamide, (2-hydroxy-3-tert-butyl-5-methylbenzyl) acrylamide, (4-hydroxy-3,5-dimethylbenzyl) acrylamide or (4-hydroxy-3,5-di-tert-butylbenzyl) methacrylamide, or mixtures of two or more of the above-mentioned compounds. The above compounds may be blended in an amount of 0.05 – 3 parts by weight to 100 parts of polybutadiene in any conventional blending manner.

The above-mentioned acrylic compounds are effective for preventing thermal cross-linking of the polybutadiene during the melt-spinning process and are hereinafter referred to as anti-cross-linking agents.

The polybutadiene to the melt-spun may be mixed, with or without the acrylic compound, with other additives, for example, anti-oxidants and lubricants. The anti-oxidant for polybutadiene may be selected from conventional antioxidants, for example, 2,2'-methylene-bis(4-methyl-6-tert-butylphenol), 2,2°-buthylidene-bis(4-methyl-6-tert-butylphenol), 2,6-di-tert-butyl-p-cresol, tetrakis[methylene-3(3,5-di-tert-butyl-4-hydroxyphenyl) propionate] methane or distealyl-3,3'-thiodipropionate or mixtures of two or more of the above-mentioned compounds. The lubricant may be selected from fatty acid diethanolamides, for example, Dianol 300 made by Daiichi Kogyo Sieyaku k. k., Japan. The additives may be mixed in an amount of 0.05 to 3 parts by weight to 100 parts by weight of polybutadiene.

The polybutadiene fibers are treated in a solution or suspension of a Lewis acid in an inert organic liquid, so that polybutadiene is cyclized and cross-linked.

The Lewis acid may be selected from the group consisting of fluorides, chlorides and bromides of boron, aluminium, titanium, tin, antimony, iron, berylium, magnesium zinc and cadmium, compounds of the formula (II):

$$R_nAlY_{3-n} \quad \text{(II)}$$

wherein R represents an alkyl radical of 1 to 3 carbon atoms, Y represents a chlorine or bromine atom and n is an integer of 1 or 2, and mixtures of two or more of the above-mentioned compounds.

The Lewis acid usable for the process of the present invention may be, for example, boron trifluoride, boron tribromid, aluminium chloride, aluminium bromide, titanium tetrachloride, tin tetrachloride, antimony pentachloride, iron trichloride, berylium bromide, magnesium chloride, zinc chloride, cadmium chloride, cadmium bromide, diethylaluminium monochloride or monoethyl aluminium dichloride. Of these compounds, aluminium chloride, aluminium bromide, titanium tetrachloride, iron trichloride and monoethyl aluminium dichloride are preferable for the process of the present invention. The above-mentioned Lewis acids are dissolved or suspended in an amount of 1 to 100 g in 1000 ml of the inert organic liquid.

The inert organic liquid usable for the Lewis acid-treatment may be selected from liquid compounds inert to the Lewis acids and to polybutadiene fibers. To fulfill these requirements, the inert organic liquid may be selected from the group including saturated aliphatic hydrocarbons, for example, n-heptane and n-hexane; alicyclic hydrocarbons, for example, cyclohexane, cyclopentane; halogenated hydrocarbons, for example, tetrachloromethane, dichloromethane, 1,2-dichloroethane, chlorobenzene, and o-dichlorobenzene; aromatic hydrocarbons, for example, benzene, toluene and xylene; and nitrohydrocarbons, for example, nitromethane, nitroethane, nitrobenzene, and mixtures of two or more of the above-mentioned compounds. Of the above-mentioned inert organic compounds, the saturated aliphatic hydrocarbons and aromatic hydrocarbons are preferable for the process of the present invention.

The Lewis acid-treatment bath may contain, as a cocatalyst, one or more additives, for example, alcohols such as methyl alcohol and ethyl alcohol, fatty acids such as acetic acid and propionic acid, hydrogen halides such as hydrogen chloride and hydrogen bromide and halogenated alkyl compounds such as ethyl bromide and tert-butyl chloride, in an amount of 0.5 mole or less with respect to 1 mole of the Lewis acid.

The treatment of the polybutadiene fibers in the Lewis acid solution or suspension is carried out at a temperature lower than the melting point of the polybutadiene fibers to be treated, preferably from 0 to 100° C, more preferably from 10 to 60° C.

The Lewis acid-treatment for the polybutadiene fibers may be effected with or without tensile stress on the fiber. Tensile stress of at most 190 kg/cm$^2$, preferably 40 to 150 kg/cm$^2$, on the polybutadiene fibers is effective for producing carbon fibers with excellent modulus of elasticity and tensile strength.

The Lewis acid-treatment is carried out to render the polybutadiene fibers insoluble in an eutectic mixture of 1 part by weight of diphenyl and 3 parts by weight of diphenylether (Dowtherm oil A) at a temperature of 120 to 130° C, and to maintain the tensile strength of the treated fiber at a level of at least 30% based on that of the original polybutadiene fibers.

The polybutadiene fibers treated with the Lewis acid are preferably washed with methyl alcohol, methyl alcohol containing hydrochloric acid, acetone or the inert organic liquids usable as the medium for dissolving or suspending the Lewis acid, so that the Lewis acid solution or suspension remaining on the fibers is completely removed.

Next, the polybutadiene fiber is treated in a sulphur bath at a temperature of 170 to 300° C to dehydrogenate and aromatize the cyclized and cross-linked polybutadiene. The sulphur bath is prepared by melting solid or rubber-like sulphur at a temperature higher than its melting point or by dissolving sulphur in an organic solvent.

In the case where the sulphur melt is used, it is preferable for the sulphur treatment to be carried out at a temperature of 220 to 270° C and in the case where the sulphur solution bath is used, it is preferable for the sulphur treatment to be effected at a temperature of 200 to 270° C. The sulphur treatment may be carried out by immersing the acid treated fibers in the sulphur melt or by passing the fiber through the sulphur melt.

The organic solvent usable for dissolving sulphur may be selected from organic compounds which are liquid at the sulphur treatment temperature and are inert to sulphur, for example, o-dichlorobenzene, biphenyl, diphenylether, chlorobiphenyl or chloro-terphenyl, and mixtures of two or more of the compounds mentioned above. The organic compounds for dissolving sulphur are used in an amount not greater than 100 parts, preferably, not greater than 20 parts, by weight with respect to 1 part by weight of sulphur. There is no advantage, from the point of view of industrial efficiency and economy, in using the organic compound in an amount greater than 100 parts by weight with respect to 1 part of sulphur, because the low concentration of sulphur in the sulphur solution results in a long dehydrogenation time of polybutadiene.

If the sulphur treatment is carried out at a relatively low temperature within the range as stated hereinbefore, it is preferable to promote the dehydrogenation. For this purpose, the sulphur treatment may be carried out in the presence of one or more organic compounds which are capable of accelerating dehydrogenation of polybutadiene, in an amount of 10 to 100 parts by weight with respect to 100 parts by weight of sulphur used in the sulphur melt or solution. The accelerating organic compound may be triphenylphosphine, aniline, N,N-dimethyl aniline, p-phenylene-diamine or m- or p-toluidine.

The sulphur treatment can be effected with or without tensile stress on the polybutadiene fibers. In order to produce carbon fibers with excellent tensile strength and modulus of elasticity, it is preferable for the sulphur treatment to be carried out with a tensile stress of at most 60 kg/cm$^2$, preferably, 4 to 40 kg/cm$^2$ on the fibers.

The sulphur treatment is carried out so that the ratio of the number of hydrogen atoms to carbon atoms in the treated polybutadiene, which ratio is hereinafter referred to as H/C, falls in a range of 0.2 to 1.0, preferably, 0.5 to 0.9 and more preferably 0.65 to 0.85. If the value of H/C is less than 0.2, a relatively low yield of carbon fibers with relatively low tensile strength and modulus of elasticity is produced. Also, if the value of H/C is greater than 1.0, the resultant carbon fibers are poor in yield and quality. Sometimes, the sulphur-treated fibers having an H/C greater than 1.0 tends to fuse or stick to each other in the subsequent carbonization step.

The sulphur-treated fibers can be subjected to a carbonization step. Before the carbonization step, however, in order to remove sulphur from the fibers, it is preferable to clean the fibers by washing with the inert organic solvent usable for preparing the sulphur solution, benzene, toluene or xylene, or by evaporating away sulphur on the fibers at a temperature of about 230 to about 300° C in a stream of an inert gas (for example, nitrogen).

Carbonization of the sulphur-treated fibers is carried out by heating the fibers to a temperature of 750 to 3000° C. In the carbonization, the sulphur-treated fibers are converted to ordinary carbon fibers at 750 to 1500° C and to graphite fibers at 1500 to 3000° C. While the temperature is increased to 750° C or higher, aromatization of the dehydrogenated polybutadiene is further promoted and, thereafter, the aromatized polybutadiene is carbonized. If necessary, the carbonization at 750 to 1500° C may be followed by the graphitization at 1500 to 3000° C. The carbonization at 700 to 1500° C is effected in an atmosphere of inert gas, for example, nitrogen, argon, hydrogen chloride, hydrogen or a mixture of the inert gas and a hydrocarbon gas, or under vacuum.

Graphitization of the carbon fibers is carried out at a temperature of 1500 to 3000° C, preferably, 2000 to 3000° C, in a non-oxidizing atmosphere, for example, in argon.

In the carbonization process, the sulphur-treated fibers are heated usually by using an electric furnace. In the graphitization process of the ordinary carbon fibers, heating may be effected by a resistively heating method or by using a graphite resistant furnace or induction furnace. Usually, heating in the carbonization step is effected at a rate of increase of temperature of 1 to 30° C/min up to 750° C. The rate of increase of temperature when heating to a temperature higher than 750° C, may be more than 30° C/min.

Carbonization can be carried out with or without tensile stress on the fibers to be carbonized. In order to produce carbon fibers having excellent tensile strength and modulus of elasticity, it is preferable for the fibers to be carbonized under a tensile stress of 45 kg/cm$^2$ or less, preferably, 4 to 40 kg/cm$^2$. Graphitization is preferably carried out while stretching the ordinary carbon fibers at a draw ratio of about 1.2 or more.

The tensile stresses in the Lewis acid-treatment, sulphur treatment and carbonization steps can be applied onto the fibers to be treated by way of hanging a predetermined weight from the fibers, or adjusting the feed and delivery velocities of the fibers so as to tighten the fibers under the predetermined tensile stress.

The process of the present invention can be carried out either batchwise or continuously.

The continuous process of the present invention will be explained in detail with reference to the accompanying drawing which shows an embodiment of an arrangement of the apparatuses for continuously carrying out the process of the invention.

Referring to the accompanying drawing, a continuous polybutadiene filament bundle is drawn out from a package 1 by rotating a pair of supply rollers 2*a* and 2*b*. The filament bundle A is fed via a tension roller 3, having a weight 3*a*, and a guide roller 4 into a treatment vessel 5 containing a Lewis acid solution B. The filament bundle is forwarded through the treatment vessel 5 guided by guide rollers 6 and 7 located within vessel 5 and, then, withdrawn from the vessel 5 by means of a pair of first intermediate rollers 9*a* and 9*b* via a guide roller 8. While the filament bundle A is passing through the Lewis acid bath B, the molecular structure of the polybutadiene is cyclized and cross-linked by the action of the Lewis acid. The filament bundle A is tightened, under a predetermined tensile stress, between the supply rollers 2*a* and 2*b* and the first intermediate rollers 9*a* and 9*b* by means of the tension roller 3 which is movable up and down.

Thereafter, the filament bundle is fed, via a guide roller 10, into a first washing vessel 15 containing a first washing liquid and then, fed, via guide roller 12, into a second washing vessel 16 containing a second washing liquid. While the filament bundle is passing through the washing liquids, the Lewis acid remaining on the filament bundle is removed. The first and second vessels 15 and 16 are provided, respectively, with guide rollers 13*a* and 13*b* therewithin.

The washed filament bundle A is fed, via a guide roller 14, a tension roller 17 having a weight 17*a* and a guide roller 18, into a treating vessel 19 containing a sulphur melt or solution C. The vessel 19 has guide rollers 20 and 21 located therewithin. While passing through the sulphur melt or solution C, the cyclized and cross-linked polybutadiene is dehydrogenated and aromatized by the action of sulphur.

Thereafter, the filament bundle is withdrawn, together with a small amount of the sulphur melt or solution, from the treating vessel 19 and is fed into a heating tube 22. In the heating tube 22, the sulphur on the filament bundle is vaporized and separated from the filament bundle at a high temperature in a stream of an inert gas. For this purpose, nitrogen gas is blown into the heating tube 22 through an inlet conduit 23 and discharged, together with the vaporized sulphur, into a recovery tank 25 through an outlet conduit 24. In the tank 25, the vaporized sulphur is solidified by cooling, and separated from the nitrogen gas. The nitrogen gas is discharged through a recovery conduit 25*a*. The filament bundle thus cleaned is withdrawn from the heating tube 22 via a guide roller 26 by means of a pair of second intermediate rollers 27*a* and 27*b*. Between the first and second intermediate rollers 9*a* and 9*b* and 27*a* and 27*b*, the filament bundle A is tightened under a predetermined tensile stress by means of the tension roller 17 which is movable up and down.

Thereafter, the filament bundle A is fed, via a tension roller 28 having a weight 28*a* and a guide roller 29, into a quartz tube 31 arranged within an electric furnace 30. While passing through the quartz tube 31, the filament bundle A is heated to a predetermined high temperature in the flow of an inert gas and is converted to a carbon filament bundle. The resultant carbon filament bundle A is drawn out from the quartz tube 31 by means of a pair of delivery rollers 32*a* and 32*b* and wound onto a package 33. Between the second intermediate rollers 27*a* and 27*b* and the delivery rollers 32*a* and 32*b*, the filament bundle is tightened under a predetermined tensile stress by means of a tension roller 28 which is movable up and down.

The present invention will be illustrated in detail by following examples, in which the percentages and parts given are based on weight. In the examples, the term "carbonization yield" refers to a percentage ratio of the weight of the resultant carbon fibers to the weight of the polybutadiene fibers from which the carbon fibers are produced. The tensile strength and modulus of elasticity of the carbon fibers were determined using a constant-rate-of-specimen-extension tension tester with a cross head speed of 5 mm/min. In order to prepare the test specimens, fibers were mounted on a stiff cardboard frame with a hard epoxy adhesive, using the "window" technique. A gauge length of 2 cm was used for the measurement.

EXAMPLE 1

Polybutadiene used herein contained 99% of vinyl structure and had a melting point of 190° C and a reduced viscosity of 0.62 dl/g. A polymer blend was prepared by blending 100 parts of polybutadiene, 1 part of acrylaminoethyl-(3,5-di-tert-butyl-4-hydroxybenzyl)ether, 0.2 part of tetrakis[methylene-3(3,5-di-tert-butyl-4-hydroxyphenyl)-propionate]methane, 0.2 part of distearyl-3,3'-thiodipropionate and 1 part of a fatty acid diethanolamide[trademark: DIANOL 300, made by Daiichi Kogyo Seiyaku K. K. Japan]. The polymer blend was melted at a temperature of 205° C and extruded through spinning orifices to form filaments each having a diameter of 22.4 $\mu$. A bundle consisting of 1,200 filaments so formed was drawn at a draw ratio of 2.8 at a temperature of 90° C to form a bundle of drawn filaments each having a diameter of 13 $\mu$. The drawn polybutadiene filaments had an initial modulus of elasticity of $16 \times 10^3$ kg/cm$^2$ and a tensile strength of $1.9 \times 10^3$ kg/cm$^2$. The polybutadiene filament bundle was immersed in a Lewis acid solution which had been prepared by dissolving 2 g of aluminium bromide in 100 ml of benzene in a nitrogen atmosphere, at a temperature of 20° C for 6 hours under a tensile stress of 90 kg/cm$^2$. The immersed filament bundle was washed with benzene, methyl alcohol containing 20% of hydrochloric acid and then, with methyl alcohol. Thereafter, the washed filament bundle was dried at room temperature under reduced pressure. The individual filaments thus treated had a tensile strength of $1.2 \times 10^3$ kg/cm$^2$. The filament bundle was then immersed in a sulphur melt at a temperature of 230° C for 5 hours under a tensile stress of 15 kg/cm$^2$. Thereafter, the filament bundle was washed with hot xylene and dried at room temperature under reduced pressure. The H/C of the filament bundle was 0.72.

Finally, the filament bundle was carbonized in an argon atmosphere by increasing the temperature of the filament bundle to 1000° C at a rate of 10° C/min without tensile stress. A carbon filament bundle was obtained with a carbonization yield of 89%. The resulting carbon filaments had a modulus of elasticity of $670 \times 10^3$ kg/cm$^2$ and a tensile strength of $8.8 \times 10^3$ kb/cm$^2$.

EXAMPLE 2

The same procedures as in Example 1 were repeated except that the carbonizing temperature was 1200° C. The resultant carbon filaments had a modulus of elasticity of $750 \times 10^3$ kg/cm$^2$ and a tensile strength of $10.5 \times 10^3$ kg/cm$^2$.

EXAMPLES 3 through 10

The same procedures as in Example 1 were repeated eight times except that the amount of aluminium bromide used and the immersing temperature and time of the filament bundle in the aluminium bromide solution were varied as indicated in Table 1-A. The filament bundles treated with the respective aluminium bromide solutions had tensile strengths as shown in Table 1-A.

Table 1-A

| Example No. | Treatment with aluminum bromide solution: Amount (g) in 100 ml benzene | Temperature (° C) | Time (hours) | Tensile strength of treated filament ($\times 10^3$ kg/cm$^2$) |
|---|---|---|---|---|
| 3 | 0.5 | 20 | 6 | 1.3 |
| 4 | 1.0 | 20 | 6 | 1.1 |
| 5 | 2.0 | 10 | 6 | 1.0 |
| 6 | 2.0 | 20 | 6 | 1.2 |
| 7 | 2.0 | 30 | 6 | 1.1 |
| 8 | 2.0 | 40 | 0.5 | 0.9 |
| 9 | 10.0 | 10 | 6 | 1.2 |
| 10 | 10.0 | 20 | 2 | 0.9 |

After the filament bundles were respectively treated with the sulphur melt, the H/C values of the filaments were as shown in Table 1-B. After the filament bundles were respectively carbonized, the carbonization yields, modulus of elasticities and tensile strengths of the resultant carbon filaments were as indicated in Table 1-B.

Table 1-B

| Example No. | H/C | Carbon filament: Carbonization yield (%) | Modulus of elasticity ($\times 10^3$ kg/cm$^2$) | Tensile strength ($\times 10^3$ kg/cm$^2$) |
|---|---|---|---|---|
| 3 | 0.70 | 87 | 640 | 12.6 |
| 4 | 0.75 | 94 | 680 | 12.2 |
| 5 | 0.73 | 92 | 650 | 9.7 |
| 6 | 0.69 | 91 | 730 | 12.2 |
| 7 | 0.72 | 88 | 670 | 12.0 |
| 8 | 0.74 | 99 | 600 | 10.3 |
| 9 | 0.72 | 89 | 650 | 11.8 |
| 10 | 0.68 | 92 | 660 | 11.5 |

EXAMPLES 11 AND 12

The same procedures as in Example 1 were repeated twice except that, as the Lewis acid, iron (II) chloride (Example 11) and aluminium chloride (Example 12) were used instead of aluminium bromide and the Lewis acid treatment was carried out under conditions as indicated in Table 2-A. Following the Lewis acid treatment, the polybutadiene filaments had tensile strengths as indicated in Table 2-A and following the sulphur treatment, the filaments had H/C values as indicated in Table 2-B. Further, the resultant carbon filaments had properties as indicated in Table 2-B.

Table 2-A

| Ex. No. | Lewis acid treatment: Lewis acid | Amount of Lewis acid in 100 ml benzene (g) | Temperature (° C) | Time (hrs) | Tensile strength of filament after Lewis acid treatment ($\times 10^3$ kg/cm$^2$) |
|---|---|---|---|---|---|
| 11 | Iron (II) chloride | 2 | 20 | 3 | 0.8 |
| 12 | Aluminum chloride | 2 | 60 | 6 | 0.9 |

Table 2-B

| Ex. No. | Sulphur treated filament H/C | Carbon filament: Carbonization yield (%) | Modulus of elasticity ($\times 10^3$kg/cm$^2$) | Tensile strength ($\times 10^3$ kg/cm$^2$) |
|---|---|---|---|---|
| 11 | 0.69 | 91 | 600 | 9.6 |
| 12 | 0.70 | 91 | 580 | 8.5 |

EXAMPLES 13 THROUGH 15

In order to produce carbon filaments, the same procedures as in Example 1 were repeated three times except that the sulphur treatments were carried out under the conditions indicated in Table 3. The H/C values of the sulphur-treated filaments and the properties of the resultant carbon filaments are also indicated in Table 3.

Table 3

| Ex. No. | Sulphur treatment: Temp. (° C) | Time (hrs) | Sulphur treated filament H/C | Carbon filament: Carbonization yield (%) | Modulus of elasticity ($\times 10^3$ kg/cm$^2$) | Tensile strength ($\times 10^3$ kg/cm$^2$) |
|---|---|---|---|---|---|---|
| 13 | 230 | 6.5 | 0.76 | 89 | 710 | 11.0 |
| 14 | 240 | 3.0 | 0.69 | 93 | 680 | 11.5 |
| 15 | 250 | 1.5 | 0.73 | 98 | 710 | 10.0 |

EXAMPLE 16

The same polybutadiene blend as used in Example 1 was melted at a temperature of 205° C and extruded through spinning orifices to produce continuous filaments each having a diameter of 24 $\mu$. A bundle of 1200 filaments thus produced was drawn at a draw ratio of 4.5 in water maintained at a temperature of 50° C and, then, heat-set at a temperature of 120° C for 10 minutes. The individual filaments had a diameter of 11.5 $\mu$, an initial modulus of elasticity of 37 $\times$ $10^3$kg/cm$^2$ and a tensile strength of 3.6 $\times$ $10^3$ kg/cm$^2$.

The above-obtained polybutadiene filament bundle was converted to a carbon filament bundle by the same procedures as in Example 1. The Lewis acid treated filaments had a tensile strength of 1.8 $\times$ $10^3$ kg/cm$^2$ and, the sulphur treated filament had an H/C of 0.72. The resultant carbon filaments had a modulus of elasticity of 870 $\times$ $10^3$ kg/cm$^2$ and tensile strength of 12.3 $\times$ $10^3$ kg/cm$^2$. The carbonization yield was 98%.

EXAMPLE 17

The same procedures as in Example 16 were repeated except that the sulphur-treated filament bundle was carbonized at a temperature of 1200° C. The resultant carbon filament had a modulus of elasticity of 940 $\times$ $10^3$ kg/cm$^2$, a tensile strength of 11.5 $\times$ $10^3$ kg/cm$^2$. The carbonization yield was 90%.

EXAMPLES 18 THROUGH 21

Four types of polybutadienes as indicated in Table 4 were used for the present examples.

Table 4

| Ex. No. | Polybutadiene: Content of vinyl structure (%) | Melting point (° C) | Reduced viscosity (dl/g) | Draw ratio | Drawn filament: Diameter ($\mu$) | Tensile strength ($\times 10^3$ Kg/cm$^2$) |
|---|---|---|---|---|---|---|
| 18 | 97 | 179 | 0.06 | 3.1 | 12.5 | 2.7 |
| 19 | 96 | 170 | 0.75 | 4.0 | 11.8 | 3.0 |
| 20 | 95 | 167 | 0.82 | 3.7 | 10.5 | 3.2 |
| 21 | 95 | 152 | 0.82 | 3.7 | 12.1 | 3.2 |

In each example, 100 parts of the polybutadiene were mixed with 1 part of acrylaminomethyl-(3,5-di-tert-butyl-4-hydroxybenzyl)ether, of tetrakis0.2 part oftetrakis[methylene-3-(3,5-di-tert-butyl-4-hydroxyphenyl)-propionate]methane and 0.2 part of distearyl-3,3'-thiodipropionate. In each example, the blend was melted at a temperature of 205° C and extruded through spinning orifices to form a bundle consisting of 1200 filaments, and the filament bundle was drawn at a temperature of 50° C in a hot water bath at a draw ratio as indicated in Table 4 and, then, heat-set at a temperature of 120° C for 20 minutes.

The heat-set filaments had diameters and tensile strengths as indicated in Table 4.

In each example, the drawn polybutadiene filament bundle was processed by the same operations as in Example 1, except that carbonization was carried out with a tensile stress of 15 kg/cm$^2$ on the filament bundle. The tensile strengths of the Lewis acid-treated filaments, H/C values of the sulphur-treated filaments and the diameters, carbonization yields, modulus of elasticities and tensile strengths of the carbon filaments are indicated in Table 5.

Table 5

| Ex. No. | Lewis acid treat-filament Tensile strength ($\times 10^3$ kg/cm$^2$) | Sulphur treated filament H/C | Carbon filament Diameter ($\mu$) | Carbonization yield (%) | Modulus of elasticity ($\times 10^3$kg/cm$^2$) | Tensile strength ($\times 10^3$kg/cm$^2$) |
|---|---|---|---|---|---|---|
| 18 | 1.3 | 0.72 | 9.8 | 90 | 820 | 10.4 |
| 19 | 1.2 | 0.74 | 11.0 | 93 | 850 | 10.9 |
| 20 | 1.4 | 0.69 | 9.9 | 93 | 870 | 10.7 |
| 21 | 1.1 | 0.75 | 11.0 | 95 | 790 | 11.4 |

EXAMPLE 22

One hundred parts of polybutadiene with an 88% of vinyl structure, a melting point of 145° C and a reduced viscosity of 0.59 dl/g were blended with 0.5 part of 2,6-di-tert-butyl-p-cresol. The blend was melted at a temperature of 180° C and extruded through spinning orifices to form a bundle of 1200 filaments. The filament bundle was drawn in a hot water bath at a temperature of 50° C at a draw ratio of 4.0. The drawn filament bundle was heat-set at a temperature of 100° C for 10 minutes. The individual filaments thus heat-set had a diameter of 11.5 $\mu$ and a tensile strength of $1.7 \times 10^3$ kg/cm$^2$.

In order to convert the polybutadiene filament bundle to a carbon filament bundle, the polybutadiene filament bundle was processed by the same operations as in Example 1, except that the Lewis acid-treatment and carbonization were carried out with respective tensile stresses of 75 kg/cm$^2$ and 15 kg/cm$^2$ on the filament bundles. The Lewis acid treated filaments had a tensile strength of $1.1 \times 10^3$ kg/cm$^2$. Also, the sulphur treated filaments had an H/C value of 0.73. The resultant carbon filaments had a modulus elasticity of $680 \times 10^3$ kg/cm$^2$ and a tensile strength of $8.1 \times 10^3$ kg/cm$^2$. The carbonization yield was 90%.

EXAMPLE 23

A polybutadiene filament bundle, as used in Example 1, was continuously converted to a carbon filament bundle using the apparatus of the accompanying drawing.

Referring to the drawing, vessel 5 was filled with a Lewis acid solution prepared by dissolving aluminium bromide in benzene, maintained at a temperature of 20° C, in a proportion of 2 g of aluminium bromide to 100 ml of benzene. Washing vessels 15 and 16 were charged with methyl alcohol containing 20% of hydrochloric acid and methyl alcohol, respectively. Vessel 19 was charged with a sulphur melt at a temperature of 250° C. The filament bundle was tightened between a pair of supply rollers 2*a* and 2*b* and a pair of intermediate rollers 9*a* and 9*b*, under a tensile stress of 90 kg/cm$^2$, which was applied by means of the tension roller 3. After passing through the Lewis acid solution B, the filament bundle was tightened between the pair of intermediate rollers 9*a* and 9*b* and the other pair of intermediate rollers 27*a* and 27*b*, under a tensile stress of 15 kg/cm$^2$ which was applied by means of the tension roller 17. Further, after sulphur removal was completed, the filament bundle was tightened between the pair of intermediate rollers 27*a* and 27*b* and the pair of delivery rollers 32*a* and 32*b*, under a tensile stress of 15 kg/cm$^2$ which was applied by means of the tension roller 28. The quartz tube 31 was filled with argon gas flowing therethrough and adjusted to a temperature of 200° C at its entry and a temperature of 1000° C at its exit. The filament bundle remained in the Lewis acid solution B for 3 hours, in the sulphur treatment bath C for 1.5 hours and in the quartz tube 31 for 80 minutes. While passing through the quartz tube 31, the temperature of the filament bundle was increased at a rate of 10° C/min.

After passing through the Lewis acid solution B, the filaments had a tensile strength of $1.3 \times 10^3$ kg/cm$^2$ and after passing through the sulphur melt C, the filament had an H/C value of 0.72.

The resultant carbon filaments had a diameter of 10.6 $\mu$, a modulus of elasticity of $700 \times 10^3$ kg/cm$^2$ and a tensile strength of $12.2 \times 10^3$ kg/cm$^2$.

EXAMPLE 24

The carbon filament bundle obtained in Example 23 was graphitized within a graphite resistant furnace by continuously passing through a carbon tube heated to a temperature of 2800° C and filled with argon gas flowing therethrough. During graphitization, the filament bundle was drawn at a draw ratio of 1.4. The residence time of the carbon filaments in the carbon tube was 30 seconds. The graphite filaments thus produced had a modulus of elasticity of $2750 \times 10^3$ kg/cm$^2$ and a tensile strength of $19.0 \times 10^3$ kg/cm$^2$.

EXAMPLE 25

A polybutadiene having a 99% vinyl structure, a melting point of 192° C and a reduced viscosity of 0.62 dl/g was used in the present example.

100 parts of the polybutadiene were blended with 1 part of acrylaminomethyl-(3,5-di-tert-butyl-4-hydroxybenzyl)-ether and 1 part of fatty acid diethanol amide (Dianol 300). The blend was melted at a temperature of 205° C and extruded through spinning orifices to produce a bundle of 100 filaments each having a diameter of 18 $\mu$. The filament bundle was drawn at a draw ratio of 1.5 at room temperature. The drawn filaments had a tensile strength of $1.7 \times 10^3$ kg/cm$^2$. A Lewis acid-treatment liquid was prepared by partially dissolving and partially suspending 6 g of aluminium chloride in 100 ml of benzene. The drawn filament bundle was immersed in the Lewis acid-treatment liquid in a nitrogen atmosphere at a temperature of 60° C for 4 hours. The treated filament bundle was washed with acetone to remove the remaining Lewis acid from the filament bundle and then dried.

A sulphur solution was prepared by dissolving, in a mixture of 1 part diphenyl and 3 parts diphenyl ether, 15% of finely divided sulphur, based on the weight of the above mixture, at a temperature of 230° C. The filament bundle was immersed in the sulphur treatment bath at a temperature of 230° C for 8 hours. The sulphur-treated filaments were shiny black. The filament bundle was washed with xylene and then dried. After completion of the Lewis acid treatment, the filaments had a tensile strength of $1.73 \times 10^3$ kg/cm$^2$ and after the sulphur treatment was completed, the filaments had an H/C value of 0.87.

The above sulphur-treated filament bundle was heated to a temperature of 1000° C at a rate of increase of temperature of 2° C/min in an argon atmosphere under a tensile stress of 15 kg/cm$^2$ and converted, with a carbonization yield of 70%, to a carbon filament bundle having a modulus elasticity of $540 \times 10^3$ kg/cm$^2$ and a tensile strength of $9.2 \times 10^3$ kg/cm$^2$.

EXAMPLES 26 THROUGH 30

The same operations as in Example 25 were repeated five times using, as a Lewis acid, the compounds indicated in Table 6, under the conditions indicated in Table 6. The resultant carbon filaments had carbonization yields, modulus of elasticities and tensile strengths as indicated in Table 6.

Table 6

| Ex. No. | Lewis acid (Lewis acid-treatment) | Amount (g) of Lewis acid to 100 ml of benzene | Temp. (° C) | Time (hr) | Sulphur treated filament H/C | Carbonization yield (%) | Modulus of elasticity ($\times 10^3$ kg/cm$^2$) | Tensile strength |
|---|---|---|---|---|---|---|---|---|
| 26 | Aluminum bromide | 2 | 20 | 1 | 0.89 | 75 | 520 | 10.5 |
| 27 | Iron trichloride | 0.5 | 76 | 4 | 0.85 | 72 | 430 | 8.1 |
| 28 | Titanium tetrachloride | 10 | 25 | 0.5 | 0.83 | 77 | 480 | 8.5 |
| 29 | ditto | 10 | 25 | 2 | 0.88 | 84 | 530 | 9.5 |
| 30 | Monoethyl aluminum dichloride | 2 | 20 | 4 | 0.90 | 73 | 520 | 9.3 |

Comparison Example 1

The same polybutadiene filament bundle treated with the same Lewis acid solution by the same procedures as in Example 1 was directly subjected to a heating process without sulphur-treatment. The heating process was carried out in an argon atmosphere by heating the filament bundle which had been treated with the Lewis acid solution, to a temperature of 1000° C at a rate of increase of temperature of 10° C/min. When the temperature reached 450° C, the filament bundle was decomposed and became liquid and, thereafter, when the temperature reached 1000° C, the liquid completely decomposed and evaporated without leaving any traces.

Comparison Example 2

The same polybutadiene filament bundle as in Example 1 was directly immersed in the same sulphur melt as in Example 1 at a temperature of 230° C, without the Lewis acid-treatment. The filament bundle was melted away in the sulphur melt.

What we claim is:

1. A process for producing carbon fibers comprising the steps of:

(a) preparing, by melt-spinning, polybutadiene fibers consisting essentially of polybutadiene which contains at least 85% of vinyl structure and has a melting point of 140 through 195° C and a reduced viscosity of 0.3 to 1.2 dl/g;

(b) drawing said melt-spun fibers at a draw ratio of about 1.3 to about 6.0;

(c) heat setting said drawn fibers at a temperature 20° C less than the melting point of the polybutadiene and not less than 70° C;

(d) treating said polybutadiene fibers with a solution or suspension of a Lewis acid in an amount of 1 to 100 g per 1000 ml of inert organic liquid at a temperature of 0 through 100° C to such an extent that the treated polybutadiene fibers become insoluble in an eutectic mixture of 1 part by weight of diphenyl and 3 parts by weight of diphenylether at a temperature of 120 to 130° C, but still maintain their tensile strength at a level of at least 30% based on the tensile strength of the original polybutadiene fibers to cyclize and cross-link said polybutadiene, said Lewis acid being selected from the group consisting of fluorides, chlorides and bromides of boron, aluminum, titanium, tin, antimony, iron, berylium, magnesium, zinc and cadmium, compounds of the formula (II):

$$R_nAlY_{3-n} \qquad \text{(II)}$$

wherein R represents an alkyl radical of 1 to 3 carbon atoms, Y represents a chlorine or bromine atom and n is an integer of 1 or 2, and mixtures of two or more of the above mentioned compounds;

(e) treating said polybutadiene fibers treated in step (d) with a sulphur melt at a temperature of 170 to 300° C under a tensile stress of 4 to 40 kg/cm$^2$ to such an extent that said treated polybutadiene fibers in this step are rendered to have a ratio (H/C) of the number of hydrogen atoms to carbon atoms in a range of 0.2 to 1.0 to dehydrogenate and aromatize said polybutadiene treated in step (d), and then, (f) carbonizing said fibers treated in step (e) by heating them to a temperature of 750° to 3000° C, whereby said fibers are converted into carbon fibers.

2. A process for producing carbon fibers comprising the steps of:

(a) preparing, by melt-spinning, polybutadine fibers consisting essentially of polybutadiene which contains at least 85% of vinyl structure and has a melting point of 140 through 195° C and a reduced viscosity of 0.3 to 1.2 dl/g and 0.03 to 3% by weight based on the weight of said polybutadiene of at least one acrylic compound of the formula:

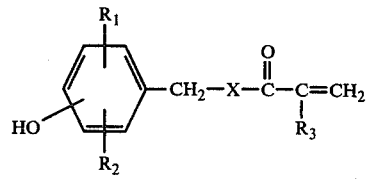

wherein X represents a member selected from the group consisting of —OCH$_2$NH—; —NH— and —O—; R, and R$_2$ each represent an alkyl radical having 1 to 4 carbon atoms, and R$_3$ is a member selected from the group consisting of hydrogen and methyl;

(b) drawing said melt-spun fibers at a draw ratio of about 1.3 to about 6.0;

(c) heat setting said drawn fibers at a temperature 20° C less than the melting point of the polybutadiene and not less than 70° C;

(d) treating said polybutadiene fibers with a solution or suspension of a Lewis acid in an amount of 1 to 100 g per 1000 ml of inert organic liquid at a temperature of 0 through 100° C to such an extent that the treated polybutadiene fibers become insoluble in an eutectic mixture of 1 part by weight of diphenyl and 3 parts by weight of diphenylether at a temperature of 120 to 130° C, but still maintain their tensile strength at a level of at least 30% based on the tensile strength of the original polybutadiene fibers to cyclize and cross-link said polybutadiene, said Lewis acid being selected from the group consisting of fluorides, chlorides and bromides of boron, aluminum, titanium, tin, antimony, iron, berylium, magnesium, zinc and cadmium, compounds of the formula (II):

$$R_nAlY_{3-n} \quad (II)$$

wherein R represents an alkyl radical of 1 to 3 carbon atoms, Y represents a chlorine or bromine atom and n is an integer of 1 to 2, and mixtures of two or more of the above mentioned compounds;

(e) treating said polybutadiene fibers treated in step (d) with a sulphur melt at a temperature of 170 to 300° C under a tensile stress of 4 to 40 kg/cm$^2$ to such an extent that said treated polybutadiene fibers in this step are rendered to have a ratio (H/C) of the number of hydrogen atoms to carbon atoms in a range of 0.2 to 1.0 to dehydrogenate and aromatize said polybutadiene treated in step (d), and then, (f) carbonizing said fibers treated in step (e) by heating them to a temperature of 750° C to 3000° C under a tensile stress of 4 to 40 kg/cm$^2$, whereby said fibers are converted into carbon fibers.

3. A process as claimed in claim 1, wherein said Lewis acid is selected from the group consisting of boron trifluoride, boron tribromide, aluminium chloride, aluminium bromide, titanium tetrachloride, tin tetrachloride, antimony pentachloride, iron trichloride, berylium bromide, magnesium chloride, zinc chloride, cadmium chloride, cadmium bromide, diethylaluminium monocloride and monoethyl aluminium dichloride.

4. A process as claimed in claim 1, wherein said inert organic liquid for dissolving or suspending said Lewis acid is selected from the group consisting of saturated aliphatic hydrocarbons, alicyclic hydrocarbons, halogenated hydrocarbons, aromatic hydrocarbons, nitrohydrocarbons or mixtures of two or more of the above-mentioned compounds.

5. A process as claimed in claim 1, wherein said Lewis acid is aluminium bromide and said inert organic liquid is benzene.

6. A process as claimed in claim 1, wherein said treatment in step b) is carried out at a temperature less than the melting point of said polybutadiene fibers.

7. A process as claimed in claim 6, wherein said treating temperature in step b) is 10 to 60° C.

8. A process as claimed in claim 1, wherein said treatment in step b) is carried out with a tensile stress of at most 190 kg/cm$^2$ on said polybutadiene fibers.

9. A process as claimed in claim 1, wherein said sulphur in step c) is in the form of a melt.

* * * * *